United States Patent [19]

Nymark et al.

[11] Patent Number: 4,884,701

[45] Date of Patent: Dec. 5, 1989

[54] ARTISTS' IMPLEMENT ORGANIZER

[76] Inventors: Hans Nymark; Ellen Nymark, both of Old Stage Rd. and Davis Pl., Mt. Shasta, Calif. 96067

[21] Appl. No.: 310,470

[22] Filed: Feb. 13, 1989

Related U.S. Application Data

[63] Continuation of Ser. No. 47,236, May 7, 1987, abandoned.

[51] Int. Cl.[4] ..... A47F 7/00

[52] U.S. Cl. ..... 211/69.8; 211/70

[58] Field of Search ..... 211/69.8, 69.1, 120, 211/70, 163, 131, 78, 89; 108/103

[56] References Cited

U.S. PATENT DOCUMENTS

| | | | |
|---|---|---|---|
| 35,780 | 7/1862 | Smith . | |
| 70,500 | 11/1867 | Averell . | |
| 231,969 | 9/1880 | Perkins . | |
| 391,186 | 10/1888 | Parker | 211/70 |
| 954,651 | 4/1910 | Shatzer | 211/69.8 X |
| 1,599,913 | 9/1926 | Nicholas . | |
| 2,929,511 | 3/1960 | Josephson . | |
| 3,327,688 | 6/1967 | Smith . | |
| 3,506,324 | 4/1970 | Fristedt . | |
| 3,552,578 | 1/1971 | Swingle . | |
| 4,305,511 | 12/1981 | Denboltz | 211/70 |
| 4,403,699 | 9/1983 | Hansen . | |

FOREIGN PATENT DOCUMENTS

| | | | |
|---|---|---|---|
| 339524 | 4/1936 | Italy | 211/70 |

*Primary Examiner*—Sarah A. Lechok

*Attorney, Agent, or Firm*—Knobbe, Martens, Olson & Bear

[57] ABSTRACT

An artists' implements organizer including a base with a centrally located hub, the hub rising up from the base and a dished portion disposed about the hub which serves as a container for small artists' implements, such as erasers and tubes of paint and the like. An elevated rim is arranged about the dish to prevent the artists's implements from sliding from the dished portion. A column is pivotally mounted to the base in an upright fashion with a rim formed about the uppermost portion thereof with a curved outwardly facing surface thereon. A spring is circumferencially seated about the curved surface of the rim formed about the uppermost portion of the column to present a spring biased gripping mechanism for elongated artist's implements such as brushes, pencils and the like. The column is open at the uppermost portion thereof to serve as a container for elongated artist's implements.

8 Claims, 1 Drawing Sheet

ARTISTS' IMPLEMENT ORGANIZER

This application is a continuation, of application Ser. No. 047,236, filed 05/07/87 now abandoned.

BACKGROUND OF THE INVENTION

1. Field of the Invention

The field of the invention relates to an artist's implements organizer, and, more particularly, to an upright turnstile-like holder for holding in an upright fashion pens, pencils, paint brushes and other similar artist's implements which is rotatably mounted to a tray forming a base for supporting the shaft of the turnstile and for providing a container for holding various other artist's implements.

2. Description of the Prior Art

The prior art is replete with various kinds and diverse types of artist's implements holders and desk organizers. Many attempts in the forms of various designs have sought to capture the market which has demonstrated a great need for a convenient, inexpensive and usable artist's implements and supplies work place organizer. Some of these devices which have been found by the inventor herein are identified and discussed as follows.

U.S. Pat. No. 35,780 (Smith) relates to a pen rack. The pen rack consists, as shown in FIGS. 1 and 4, of a pedestal stand with a plurality of notches cut in a disc-shaped object which is mounted on top of the pedestal. Pens are simply hung into each of the notches and are supported thereby.

U.S. Pat. No. 70,500 (Averell) relates to a card holder. This invention includes a pedestal-base and a tabletop structure which is mounted and secured to the top of the pedestal. As shown in FIGS. 1 and 2 of the drawings, a coiled spring is mounted circumferencially about the tabletop. The purpose of the spring is to grippingly hold a business card, or the like, for presentation to people who would take the card therefrom. No mention is made of using this in any other capacity other than to hold a business card. No pens are mentioned, and, certainly, there is no receptacle in the center portion thereof for the receipt of pens or other articles. The tabletop extends over the pedestal base which is not true in the Applicant's product.

U.S. Pat. No. 231,969 (Perkins) relates to a pen rack. As shown, a ribbon of apparently metal material is used to springingly hold a plurality of pens arranged in a semicircular base.

U.S. Pat. No. 1,599,913 (Nicholas) relates to a paper slip holder. As shown in the Figures, there is a cup 17 which is secured to a base which is pivotally movable about portion of the pedestal base and is secured thereto. Slips of paper, identified at 16, are placed in between the coils of the spring which hold them in position. This particular device is useful in restaurants. The slips are counter slips to be used by the cook in identifying what he is to prepare for the customer. The cup forms a receptacle or holder for toothpicks or matches, as desired.

U.S. Pat. No. 2,929,511 (Josephson) relates to the use of crimped wire tubing for purposes of support. Basically, this device uses crimped wire in a plurality of arrangements such as are identified, for example, at FIGS. 5 and 7, for holding pencils, pens and other items.

U.S. Pat. No. 3,327,688 (Smith) relates to a desk organizer. This is a junk box-like device which is substantially different than which is proposed by Applicant's invention. It contains no spring holder device whatsoever, and merely characterizes what is generally available in the prior art.

U.S. Pat. No. 3,506,324 (Fristedt) relates to a drawing board device which includes a receptacle for holding various pens and other utensils typically used in drawing. This contains a bucket or tray identified at 10 with a cover 18 which serves as a drawing board as well.

U.S. Pat. No. 3,552,578 (Swingle) relates to an expandable retainer. This device is useful for holding magazines and the like. It is of general construction, and although it uses a spring and circular form, it does not teach a receptacle and pedestal combination such as envisioned by Applicant's device. Also, the Applicant's device includes a pivotal pedestal combination which is not found in this patented device.

U.S. Pat. No. 4,403,699 (Hansen) relates to a holding device for pencils and the like. Basically, as shown in the Figures, it is determined that this is an expanded meshtype of device which has devices to be held thereby. It does not envision the same or similar structure as shown in the Applicant's device.

SUMMARY AND OBJECTS OF THE INVENTION

Basically, the present invention includes an artists' implements organizer including a base with a centrally located hub, the hub rising up from the base and a dished portion disposed about the hub which serves as a container for small artists' implements, such as erasers and tubes of paint and the like. Arranged about the dish is an elevated rim to prevent the artist's implements from sliding from the dished portion and to contain any paint or other fluids which might be draining from a freshly used bush or pen. A column is pivotally mounted to the base in an upright fashion with a rim formed about the uppermost portion thereof with a curved outwardly facing surface thereon to provide a seat for a circumferencially mounted spring which acts to present a spring biased gripping mechanism for elongated artist's implements such as brushes, pencils and the like. Further, the column is hollow and is opened at the uppermost portion thereof to serve as a container for holding elongated artist's implements.

It is an object of the invention to provide a new and improved device for holding pencils, brushes, pens, and other objects having elongated stems or bodies.

Another object of the present invention is to provide a holding device which utilizes a flexible spring-like gripping mechanism for retaining such objects in an at-ready-for-use position.

A yet still further object of the instant invention is to provide an artist's implements holding device of the above character which incorporates a base having a tray for holding other artist's implements.

It is one object of the invention to provide a tray for catching the paint, ink or other fluids which may drip from the artist's implements held by the holding device of the present invention.

Another object of the invention is to provide a device for organizing various artist's implements in a separated, upright, easily accessible fashion and ready for use by the artist.

It is one yet still further and important object of the invention to provide a device of the character described which incorporates a rotatable, turnstile-like holder for pens, pencils, paint brushes so that the artist can readily move the holder to a position where the desired implement may be accessed.

Other objects of my invention in part will be obvious and in part will become apparent in the following description.

My invention accordingly consists in the features of construction, combination of elements and arrangements of parts which will be exemplified in the desk organizer hereinafter described and of which the scope of application will be indicated in the appended claims.

In the accompanying drawings in which is shown one of the various possible embodiments of my invention:

DESCRIPTION OF THE PREFERRED EMBODIMENT OF THE INVENTION

Figure 1:
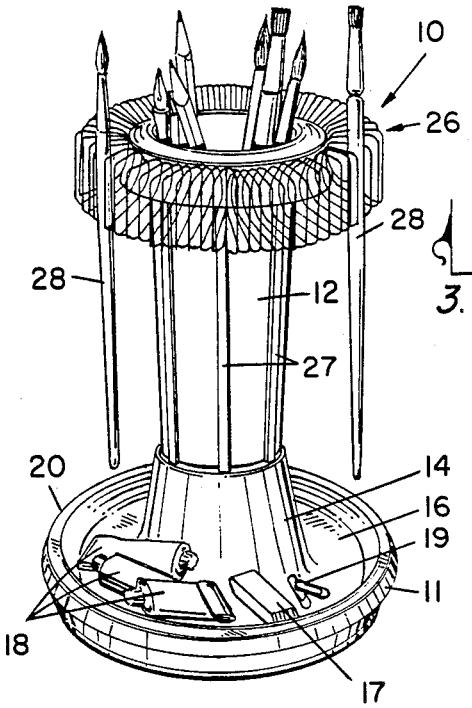
FIG. 1 is a perspective view of the present invention described herein.

With continuing reference now to all of the drawings herein, and with special emphasis now on FIG. 1, there is shown an artist's implements organizer generally indicated at 10, and identified as an artist's implements organizer. The artists' implements organizer 10 basically includes a base 11, a column 12, pivotally mounted to the base 11, and a spring 13 circumferencially disposed about the upper or top portion of the column 12.

The base unit 11 includes a centrally located hub 14 having a receptacle 15 therein. The hub 14 portion is characterized by an upthrusted portion which in this particular embodiment is disposed above the balance of the base unit 11. It should be clearly noted, however, that the hub 14 portion of the invention does not have to rise above the balance of the base unit 11 for purposes of the inventive and unique characteristics of the present invention. Disposed about the hub 14 is a dished portion 16 which serves as a container for small artists' implements, such as erasers 17 and tubes of paint 18 and even paper clips 19, and the like. In order to prevent such small items as these from sliding from the dished portion 16, there is a rim 20 which is arranged circumferencially about the dished portion 16 which rises about the floor of the dished portion 16.

Pivotally engaged with the receptacle 15 of the hub 14 is the bottom portion 21 of the column 12. The purpose and functional characteristics of the column 12 will become increasingly clear and apparent as the description of the invention proceeds further herein. The column 12 consists of a bottom portion 21 and a top portion generally shown at 22. The bottom portion 21 is necked down to form a flange-like annular column support surface 23. The column 12 is open at the upper portion 22 to serve as a receptacle 24 for elongated artists' implements such as pencils, pens, paint brushes and the like, such as shown and illustrated in FIG. 1. Vertical ribs 27 may be includes on the exterior of the column 12 to provide a means for easily rotating it with the fingers. Rimming the upper portion 22 of the column 12 is a spring locating and mounting surface 25.

Figure 2:
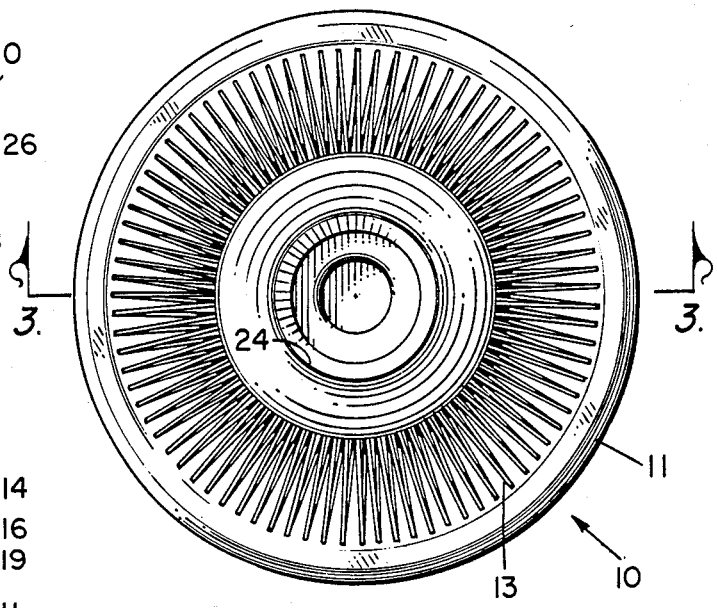
FIG. 2 is a plan or top view of the instant invention.
Figure 3:
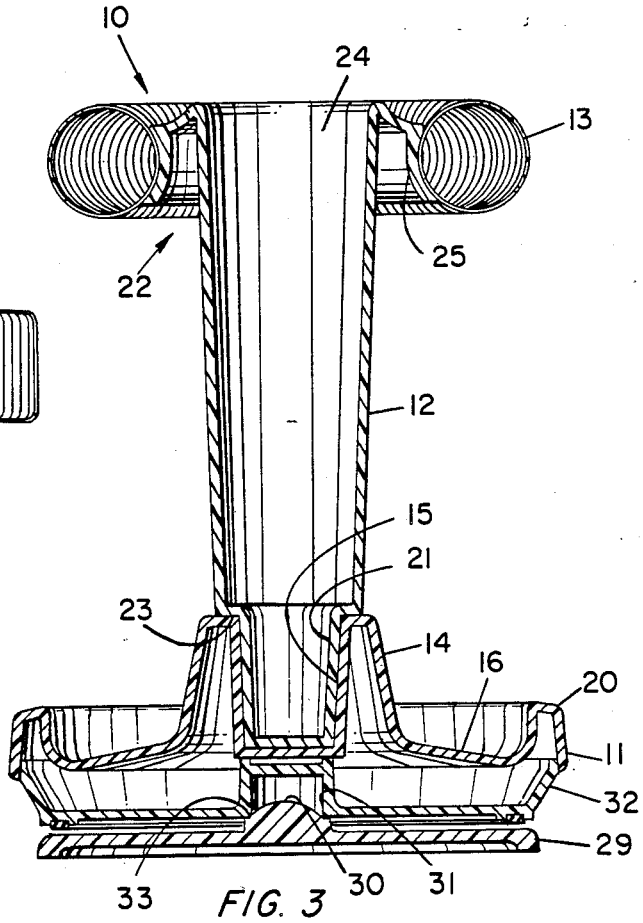
FIG. 3 a view taken along Plane 3—3 of FIG. 2.

As shown in FIGS. 2 and 3, a spring 13 is circumferencially mounted about the spring locating and mounting surface 25. The spring 13 in order to be mounted about the surface 25 must be expanded before it is mounted about the surface 25. When this spring 13 is expanded and mounted about the surface 25, the tension force inducted in the body of the spring 13 creates a gripping action whereby the spring 13 is securely mounted about the surface 25 and held thereabout by the forces created by the expansion of the spring 13.

Figure 4:
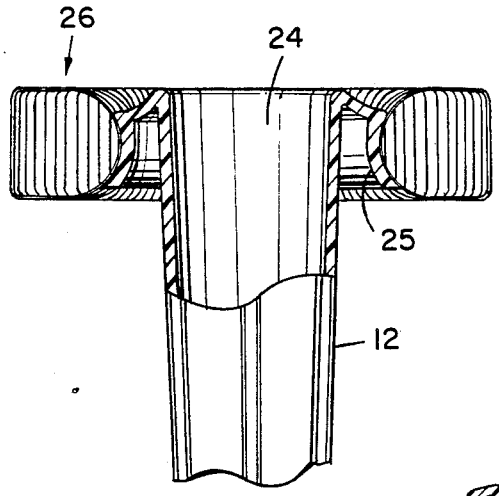
FIG. 4 is a view of a portion of the invention depicting in partial cutaway vertical form the upper portion of the spring holder of the invention and depicting a spring having a D shaped cross-section which is an alternate embodiment of the circular cross-section of the spring shown in FIG. 3.

An alternate type of spring 26 is shown in FIG. 4. This spring 26 has a D-shaped cross-section. The purpose and advantages of this D-shaped spring 26 will become readily apparent as the description proceeds further hereinafterwards.

Alternatively, it may well be desirable to include a base which functions as a "lazy susan", or turntable. As clearly depicted in FIG. 3, there is shown a turntable 29 which has a center locating raised portion at 30 which is operatively mated with the recessed portion 31 in the bottom 32 of the base 11. Because the rim 33 of the recessed portion 31 rests upon the raised portion 30 which is operatively mated with the recessed portion 31 in the bottom 32 of the base 11, clearance in the form of a spaced-apart relationship is effectuated to permit relatively uninhibited rotation between the raised portion 30 and the bottom 32 of the base 11.

Figure 5:
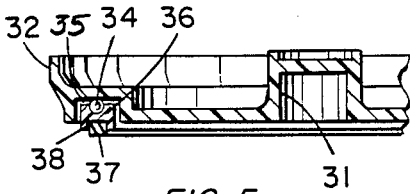
FIG. 5 is a view of an alternative embodiment of the lazy susan or turntable portion of the invention and is shown in an enlarged, partial cutaway vertical elevational section.

In some situations and applications, another alternative embodiment may be preferred as shown in FIG. 5, a lazy susan based upon a ball-bearing supported system may be used instead of the rim 33 and raised portion 30 engagement arrangement shown and depicted in FIG. 3. A plurality of ball bearings 34 (only one of such ball bearings is shown) is operatively captured within a recessed portion 35 rimming the underside portion of the ball bearings 34. A rubber or plastic ring 37 is mated with a recessed portion 38 of the ring 36 to provide a non-skid surface whereby when such is placed on a desk surface, or the like, it will not slide thereacross and will remain in the position where it is placed thereon. With this arrangement, the entire device is supported by the ball bearings 34 for ease of rotation.

OPERATION AND USE OF THE INVENTION

Operation and use of the invention herein may be described as follows:

This basic three piece invention is assembled as shown in FIG. 1.

As depicted in FIG. 1, the dished portion 16 of the base unit 11 is used to hold various non-elongated artists' supplies and implements such as erasers 17, paint tubes 18 and even paper clips 19.

The column 12 which is rotatably mounted to the base unit 11 via the receptacle 15 in the hub 14 is hollow and is open at the upper portion 22 and serves as a receptacle 24 for elongated artists' implements. Typically this receptacle 24 is used to segregate dried or artists' supplements which are dry from other elongated artists' implements. In the event that any of the artists' implements are deposited therein for storage, any fluids thereon will drip into the receptacle 15 and not on the artists' desk or work counter.

Various in use at the present time artists' implements, such as various paint bushes 28 are pushed in between the coils of the spring 26. The built-in spring tension will grip the elongated handles of the brushes 28 and hold them in a relatively fixed, immobile position until needed by the artist.

Use of the D-shaped spring coils of spring 26, as depicted in FIGS. 1 and 4, provides for a wider gripping area than that which is provided by the circularly shaped spring as depicted in FIGS. 2 and 3. Consequently, for artisan applications, the D-shaped spring 26 may be more desirable since such a wider gripping area would improve the effective gripping action of the spring with respect to the item being held. However, in practice, both the circular cross-sectioned spring and the D shaped cross-sectioned spring have been found to be generally equally acceptable for use in the fashion disclosed and taught herein.

It should be noted, as previously described herein, the entire upper portion of the device may be rotated using the turntables, or "lazy susans", as shown in FIGS. 3 and 5.

For ease of description, the principles of the invention have been set forth in connection with but the preferred illustration embodiments. It is not our intention that the illustrated embodiments nor the terminology employed in describing them be limiting inasmuch as variations of these may be made without departing from the spirit of the invention. Rather, we desire to be restricted only by the scope of the appended claims.

What we claim is:

1. An artists' implement organizer, comprising:

a base having a bottom portion and a top portion, including a centrally located hub having an upwardly-facing receptacle therein and an annular dish about said hub;

an elongated hollow column having a bottom end which fits within the receptacle in the base whereby the column is supported by the base in a vertical orientation, said column having an open top end forming a receptacle therein for receiving elongated artist implements in a substantially vertical orientation and said column having an arcuately shaped, outwardly facing spring locating and mounting surface thereabout spaced radially outwardly from said open top end; and a helically-wound spring means adapted to be operably mated to and mounted on the spring locating and mounting surface on the column, held thereon by forces within said spring means created upon its expansion and placement about the mounting surface, and said spring means having a plurality of closely spaced vertically oriented coils capable of gripping the sides of elongated artist implements and holding them vertically, said spring means being vertically aligned with said dish and being spaced above the dish sufficiently that the lower ends of the implements are spaced above, but over the dish of said base for the collection of matter from the elongated implements held by the coils.

2. The artists' implements organizer of claim 1, wherein said base further includes a turntable mechanism adapted to be operably disposed thereinunder.

3. The artists' implements organizer of claim 2 wherein said turntable mechanism comprises:

(a) an annular ring with flat sides, said sides having a top portion and a bottom portion, said bottom portion having an elastomeric ring thereabout;

(b) means operably associated with said top portion of the side of the annular ring so as to provide for slidable interaction between said bottom of said base and the top portion of the side of the annular ring.

4. The artists' implements organizer of claim 3, wherein said means operably associated with said top portion of the side of the annular ring so as to provide for slidable interaction between said bottom of said base and the top portion of the side of the annular ring, comprises:

(a) a plurality of balls;

(b) race means for operatively captivating and housing said plurality of balls in spaced apart relationship;

(c) groove means disposed in the bottom of the base; and (d) a non-slip pad operatively secured to the bottom of the base.

5. The artists' implements organizer of claim 4, wherein said non-slip pad is shaped in the form of annular ring.

6. The artists' implements organizer of claim 1 wherein said column further includes a plurality of vertically-disposed raised portions projecting outwardly therefrom.

7. The artists' implements organizer of claim 1 wherein said spring means has a relatively circular cross-section.

8. The artists' implements organizer of claim 1 wherein said spring means has a D-shaped cross-section with the non-arcuate portion thereof arranged to face outwardly from the spring locating and mounting surface on said top end of the column.

* * * * *